US005279536A

United States Patent [19]

Abreu

[11] Patent Number: 5,279,536

[45] Date of Patent: Jan. 18, 1994

[54] HANDLING APPARATUS FOR A CONTINUOUS WEB OF Z-FOLD COMPUTER PAPER

[76] Inventor: Michael L. Abreu, 16603 Clovermead St., Covina, Calif. 91722

[21] Appl. No.: 959,282

[22] Filed: Oct. 9, 1992

[51] Int. Cl.[5] ..... B41F 13/60; B65H 45/101

[52] U.S. Cl. ..... 493/23; 493/410; 493/412; 270/39; 414/790; 226/108; 226/118

[58] Field of Search ..... 493/410, 411, 412, 27, 493/23; 414/790 X, 790.1, 790.8, 926; 226/108 X, 27 X, 28, 36, 118; 270/1.1, 39

[56] References Cited

U.S. PATENT DOCUMENTS

| | | | |
|---|---|---|---|
| 1,569,033 | 1/1926 | Reichel . | |
| 3,160,413 | 12/1964 | Faeber . | |
| 3,255,895 | 6/1966 | Klingler . | |
| 4,406,650 | 9/1983 | Felix | 493/412 X |
| 4,730,762 | 3/1988 | Felix | 270/39 X |
| 4,750,724 | 6/1988 | Herd et al. | 270/39 |
| 4,778,165 | 10/1988 | Buck | 493/412 X |
| 4,842,572 | 6/1989 | Roth | 493/410 X |
| 4,842,573 | 6/1989 | Peter et al. | 270/39 X |
| 4,846,454 | 7/1989 | Parkander | 493/412 X |
| 4,928,940 | 5/1990 | Dash | 270/39 X |
| 4,934,687 | 6/1990 | Hayden et al. . | |
| 5,092,573 | 3/1992 | Abreu | 270/39 X |
| 5,104,107 | 4/1992 | Dash | 270/39 |
| 5,110,101 | 5/1992 | Roth | 270/39 |

*Primary Examiner*—Edward K. Look
*Assistant Examiner*—John Ryznic
*Attorney, Agent, or Firm*—Alan H. Thompson; Howard D. Lambert

[57] ABSTRACT

Apparatus for handling a continuous web of Z-fold computer paper discharged from a printer includes a conveyor having spaced apart paper stacking and stacked paper removing regions. Included in the apparatus is a plurality of stacking blades moveable in a generally horizontal plane between extended and retracted positions. The blades are also moveable between upper and lower positions; in their upper position the extended blades are directly above the stacking region in a position to intercept a stream of paper from the printer, the intercepted paper forming an intermediate stack on the extended blades. When the blades are in their upper and retracted positions, they are positioned out of the stream of paper. In their lower position, the extended blades are directly below the conveyor paper stacking region. The extended blades and conveyor are relatively configured so that the blades can pass through the conveyor stacking region on their way to their lower position so that an intermediate stack of paper on the blades is deposited onto the stacking region for completion of the stack.

33 Claims, 8 Drawing Sheets

150
148
144
130
163
146
9
36
140
132
142
150
146
86
138
134
9
246
104
62
68
246
240
32
74
4
54
72
66
60
64
72
68
68
74
74
74
4
64
74
226
228
64
248
222
224
248
84
7
104
114
8
94
82
254
256
80
116
102
98
118
242
34
92
7
8

FIG. 4.
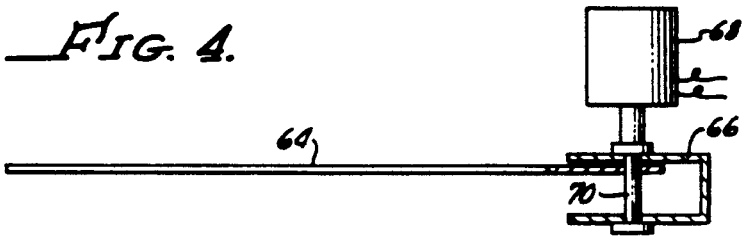
FIG. 5.
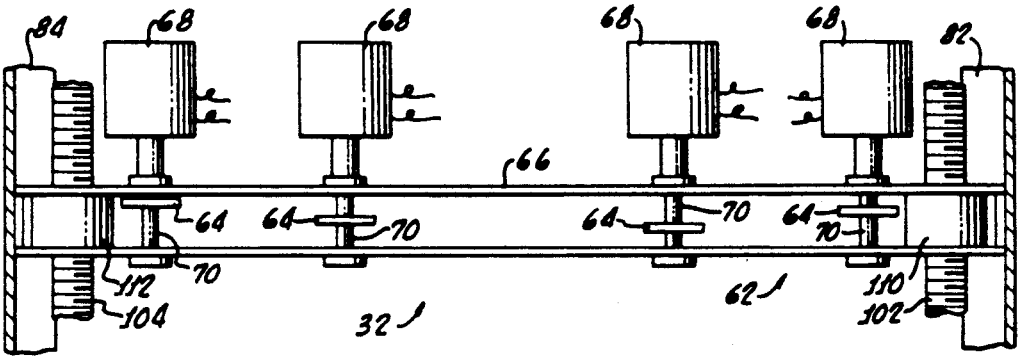
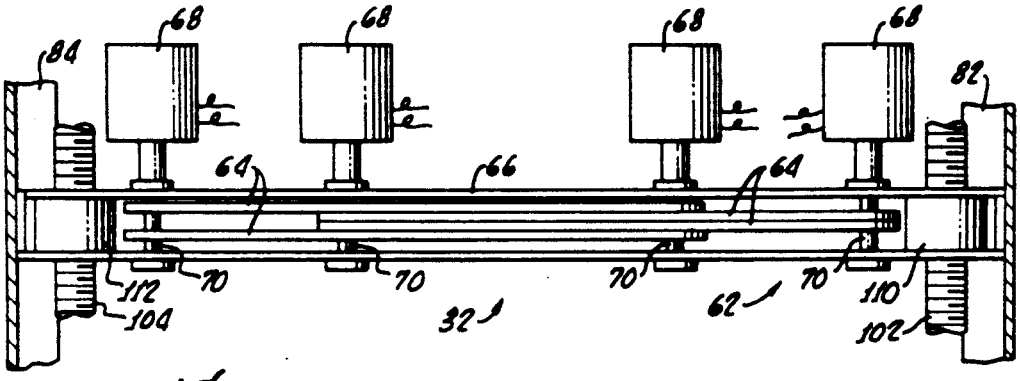
FIG. 6.
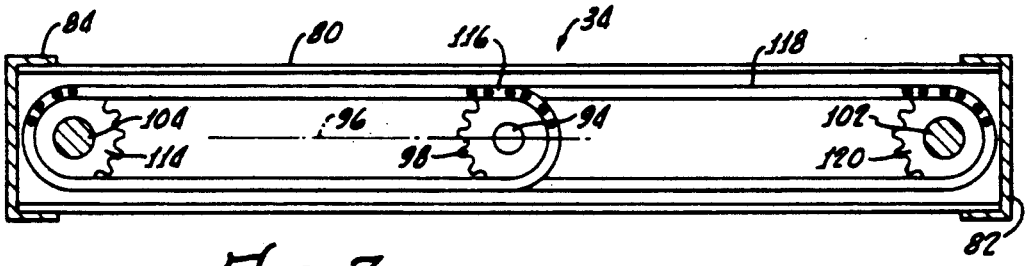
FIG. 7.

FIG. 8.
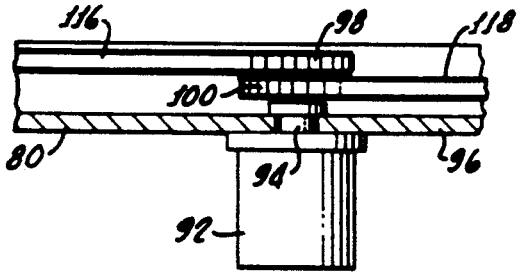
FIG. 9.
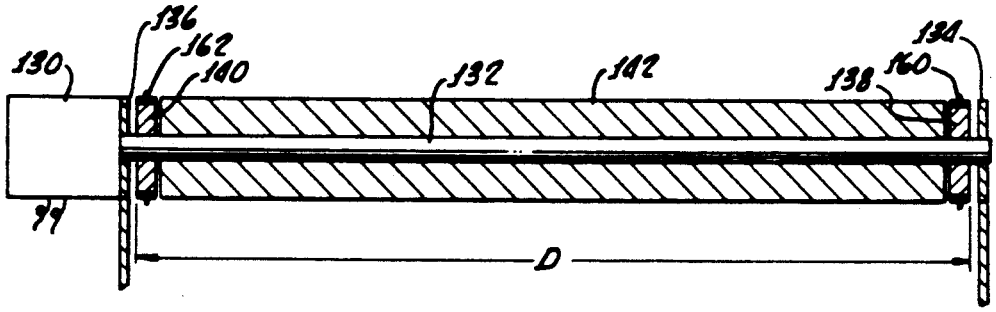
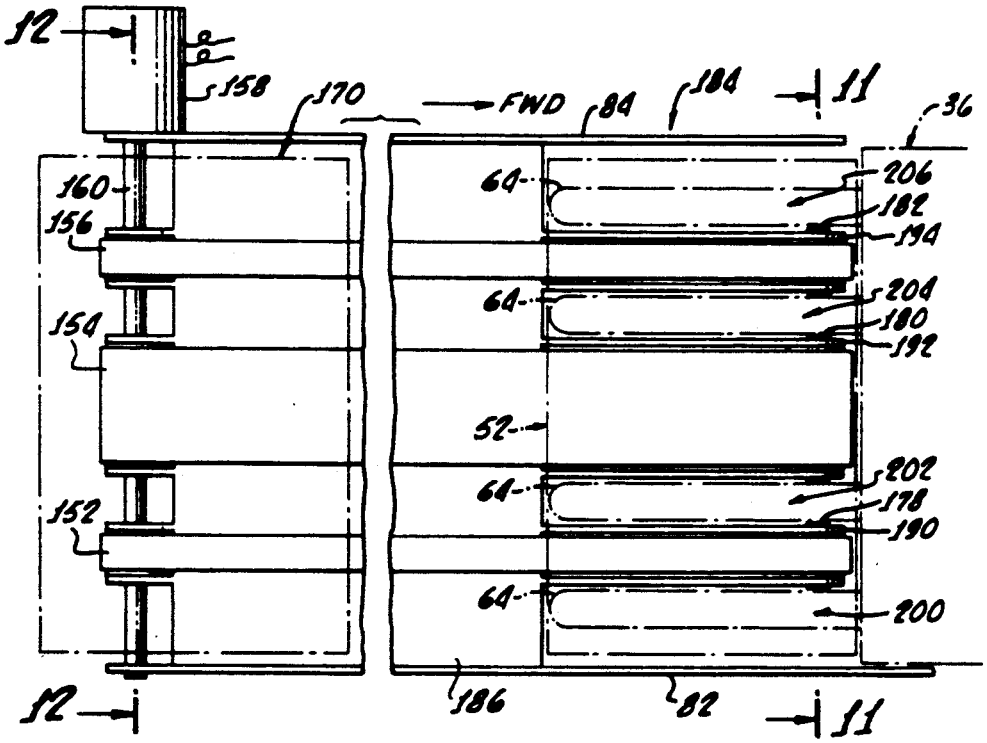
FIG. 10.

FIG. 11.
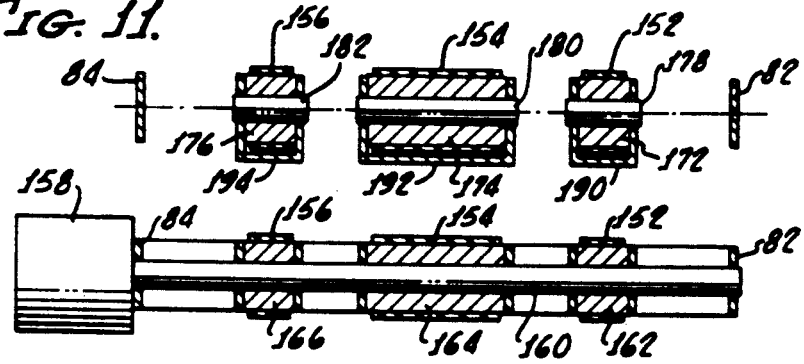
FIG. 12.
FIG. 15.
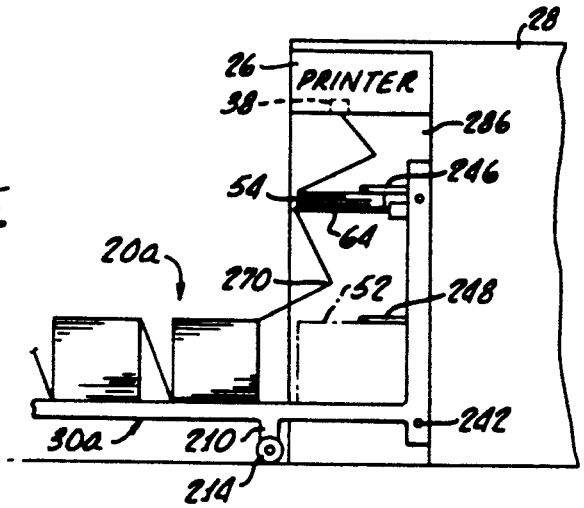
FIG. 16.
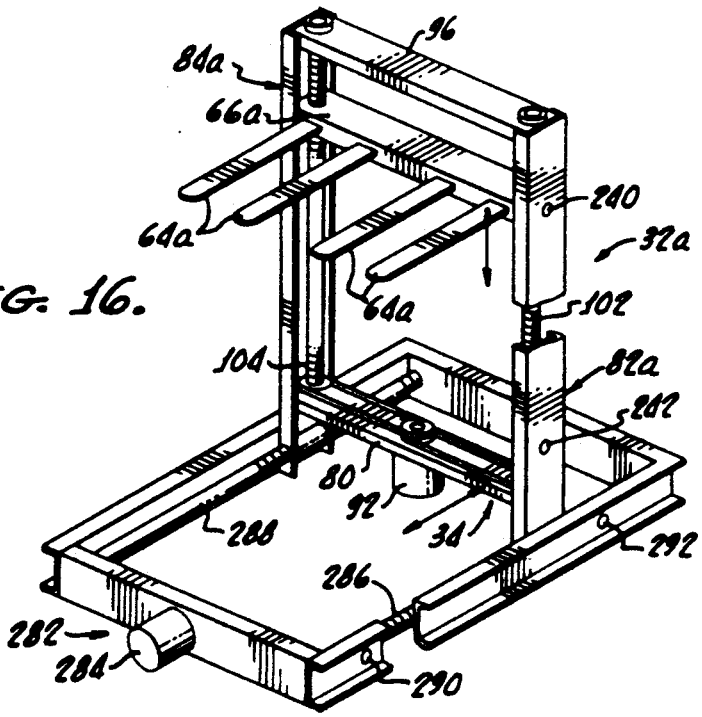

HANDLING APPARATUS FOR A CONTINUOUS WEB OF Z-FOLD COMPUTER PAPER

BACKGROUND OF THE INVENTION

1. Field of the Invention

The present invention relates generally to the field of apparatus for the handling of continuous webs of paper and, more particularly, to apparatus for handling a continuous web of Z-fold (fan-fold), tractor-feed computer paper that is discharged from a printer, such as a printer associated with a computer.

2. Background Discussion

It is well known that many computer printers, especially high speed printers associated with large computers, print on a continuous web of Z-fold (also often referred to as "fan-fold" or "accordion-fold") computer paper that has a row of sprocket or pin drive holes along each side edge. In operation, motorized drive sprockets or pin-studded belts associated with the printers engage these drive holes, thereby enabling the continuous webs of computer paper to be advanced at a selected printing speed through the printers. Such belt-type paper drives are sometimes referred to as "tractor" drives because of the resemblance of the studded paper drive belts to tractor treads.

Such continuous Z-fold paper is "divided" into "sheets," for example, 11 by 14 inches or 8½ by 11 inches in size, that are separable one from another along transverse fold lines, the paper being slightly perforated or otherwise weakened at these fold lines so that, as desired or needed, the sheets can be easily separated one from another by tearing or "bursting."

Ordinarily, the two narrow strips along the sides of the paper through which the two opposing lines of drive holes are formed are also scored so they can be easily separated from the rest of the sheets. In this manner, individual computer printout sheets, comparable to standard sheets of paper, can easily be obtained for filing, copying or the like.

During printing, however, it is ordinarily highly desirable, if not necessary, for the sheets of the continuous web of computer paper to remain joined to one another so that the proper printing continuity is automatically maintained without the need for operator intervention or supervision. Although there are some single sheet printers which print on individual sheets of paper, such printers are not ordinarily used for high through-put as is needed for today's large, high speed computers.

Many high speed printers that print on a continuous web of Z-fold computer paper are constructed with a printed computer paper receiving bin directly beneath the paper discharge region of the printer. Because of the Z-fold construction of such continuous web of computer paper, when the paper exits the printer and falls into the bin under gravity, the paper naturally folds back and forth on itself along alternating transverse sheet separation lines so that a stack of sheet-sized printed computer paper is formed, with the top of each page (except the first page) being joined to the bottom of the preceding page. Representative of such high speed printers having integral, printed computer paper stacking bins is the SIEMENS-NIXDORF 2140 Model 3 electronic printing system.

An inherent disadvantage of such printers with integral stacking bins is that the bins necessarily have limited paper stacking capacity. This tends to be less than optimal, particularly when the printers are fed a very long continuous web of computer paper whose length is greater than can be stacked in the stacking bins after printing. As an illustration, my prior U.S. Pat. No. 5,092,573 discloses a Z-fold computer paper feeding apparatus for feeding to a printer a continuous web of computer paper that can have an extremely long length, as is highly desirable for modern high speed printers. Obviously, when the integral bin of a printer having such a bin becomes full (i.e., at most when the paper stack reaches the height of the bin), the stack must be manually removed by a printer operator or attendant. The printer cannot continue to process printed information until this stack removal chore is accomplished. Thus, data center operations are disrupted and the potential through-put of these high speed printers is reduced.

For the above-mentioned reasons, it is desirable to provide a means to accomplish this printed paper removal chore while the printer continues to process printed forms (i.e., continues to print).

Although various patents known to the present inventor disclose apparatus and methods for the stacking of cut sheets of paper or printed articles, commonly called "signatures," they do not disclose apparatus and methods for stacking Z-fold computer paper in an efficient and reliable manner that maintains the integrity of the continuous web of paper. U.S. Pat. No. 4,934,687 to Hayden, et al., for example, discloses a high speed stream fed stacker method and system f or printed products; however, the patent is applicable only to the stacking of printed signatures from a high speed printing press. In such case, all the signatures in a run would be expected to be identical and so there is no necessity for maintaining order, much less continuity between the signatures.

U.S. Pat. No. 3,255,885 to Klingler discloses a signature stacking mechanism for the stacking of printed signatures for packaging, but this patent also is not applicable to the stacking of a continuous web of Z-fold computer paper after it has been printed. In this same line, U.S. Pat. No. 3,160,413 to Faeber discloses method and apparatus for supporting stacks of printed signatures. Again, such apparatus is applicable to individual printed products and in not applicable to the stacking of Z-fold computer paper.

Some high speed printers use a roll feed system whereby the printer discharges the printed paper onto a take-up roll instead of permitting the paper to stack in the usual manner. While such a specialized printing system has the advantage of avoiding paper stacking problems such as those mentioned above, it has the disadvantage that the first printed "sheets" are at the center of the take-up spool and the last-printed sheets are at the outside of the roll formed on such take-up spool. This is in reverse order of what is ordinarily required. Therefore, the printed roll would normally have to be fed either onto a second take-up spool so that the first-printed sheets are the first ones accessible on the second spool or else fed into a special stacking apparatus. While such a specialized printing system has the advantage of avoiding paper stacking problems such as those mentioned above, it has the disadvantage of requiring additional equipment to process the printed roll into individual sheets. This equipment takes up valuable floor space, is not easily moved about, and is expensive to maintain. Moreover, the initial cost of such equipment makes it impractical for most applications.

For these and other reasons, the present inventor had invented a highly efficient Z-fold computer paper handling apparatus that is adaptable for use with conventional high speed printers which normally discharge the printed paper into an integral or associated bin, the inventor's apparatus automatically enabling the stacking of a number of interconnected stacks of paper on a conveyor.

SUMMARY OF THE INVENTION

In accordance with the present invention, an apparatus is provided for handling a continuous web of Z-fold computer paper, especially as the web is discharged from a printer, such as a high speed computer printer. The apparatus comprises conveyor means having a Z-fold paper stacking region positionable relative to the printer for receiving a continuous web of Z-fold computer paper discharged therefrom and for permitting the received paper to stack in the normal back-and-forth normal manner, and having a spaced apart Z-fold stack removing position from which interconnected stacks of Z-fold paper formed on the conveyor means are removed.

Included in the apparatus is a plurality of stacking blades, preferably four spaced apart blades, movable between an extended position and a retracted position, preferably in a horizontal plane. Elevating means are provided for causing the assembly of blades to move between a first, upper position above the conveyor means and a second, lower position below the conveyor means.

In the upper position the blades, when in their extended position, are above the conveyor stacking region and are positioned to intercept a stream of Z-fold computer paper from the printer so as to enable the paper to form an intermediate paper stack on the blades, the blades in their upper, retracted position being positioned so as not to intercept the stream of Z-fold paper.

The blades and conveyor means are relatively configured such that when the extended blades are moved from their upper position to their lower position the blades pass through the conveyor means. This enables an intermediate or initiating stack of paper formed on the extended blades to be deposited from the blades onto the stacking region when the blades de-elevate to their lower position so that the stacking can continue to form a normal, large stack on the conveyor stacking region.

The paper handling apparatus of the present invention further includes operating means responsive to a stack of Z-fold computer paper forming on the stacking region reaching a preestablished stack height for causing, in sequence: (i) the elevating means to have the blades at their first, upper position and the blades to be in their retracted position, (ii) the blades to move from their retracted position to their extended position so as to intercept the web of computer paper from the associated printer upstream of the conveyor stacking region and to thereby enable the web of paper to start stacking on the extended blades, (iii) the conveyor means to move the just-formed stack of Z-fold paper out of the way of a next stack of paper to be stacked at the stacking region, (iv) the elevating means to move the extended blades to their lower position so that the intermediate stack of paper is deposited from the blades onto the stacking region of the conveyor means, so as to enable a next stack of Z-fold paper to stack onto the intermediate stack as the next stack on the stacking region, and (v) the blades to move to their retracted position so that they can be moved back upwardly to their upper position without having to pass through the conveyor stacking region.

In accordance with a preferred embodiment of the invention, the blades are pivotally mounted for rotation through about 90 degrees between their retracted position and their extended position.

For efficient operation and in order to enable the blades to be constructed to be light in weight, it is preferred that the preestablished height of the intermediate stack of Z-fold paper formed on said blades is substantially less—and may be less than about 25 "sheets"—than the preestablished height of the stack of Z-fold paper formed on said stacking region of the conveyor means—which may be more than an thousand "sheets." The intermediate stack is preferably formed for only as long as is required to move the just-formed stack of paper from the conveyor stacking region to a next, downstream position on the conveyor.

The paper handling apparatus of the present invention preferably includes position sensing means for sensing when the stack of Z-fold paper forming at the conveyor stacking position reaches its preestablished height, when the intermediate stack of Z-fold paper formed on the extended blades reaches its preestablished height, and when the conveyor means has moved a stack of Z-fold paper from the stacking region to the next downstream position which permits the extended blades to deposit their intermediate stack of Z-fold paper onto the stacking region without interference with the stack of previously-stacked paper and without breaking the web of paper that extends between the top of the just-moved stack of paper and the bottom of the just-deposited intermediate stack of paper. The operating means are responsive to signals from the position sensing means.

In further accordance with a preferred embodiment of the invention, and particularly for use when the paper handling apparatus is used in conjunction with a preexisting printer, the apparatus includes an auxiliary Z-fold computer paper drive means adapted to be disposed between the printer and the upper position of the blades. This enables the web of computer paper being discharged from the printer to hang in a loose open loop between the printer and the auxiliary paper drive means so as to prevent tearing of the paper web between sheets. In this case, there may advantageously be provided paper proximity sensing means disposed between the auxiliary drive means and the printer near the loop of paper. The paper proximity sensing means is operative for sensing when the loop of computer paper formed between the printer and auxiliary drive means is larger or smaller than a preestablished size.

Responsive to such paper proximity sensing means, the operating means causes the auxiliary paper drive means to speed up when the loop of computer paper is sensed to be too large (and may, for example, drag on the floor or become entangled with the equipment) and for slowing down the auxiliary paper drive means when the loop of computer paper is sensed to be too small (and may, for example, increase the risk of separation of the paper web between sheets).

The sensing means of the apparatus also include means for sensing when the conveyor means has moved a stack of Z-fold paper to the stack removing position, and the operating means preferably include means connected to the printer for turning the printer "off" when a stack of Z-fold paper reaches the stacking removing position and is not removed therefrom in a preestablished time.

Although it is considered unlikely that any malfunction of the apparatus would be caused by the blades striking a sheet-separation fold line when the blades are being moved to their extended position, the possibility may nonetheless be entirely avoided by providing the paper handling apparatus with means for directing a puff of compressed gas (for example, air) toward the web of computer paper in the region of the blades as the blades are moved into their extended position from their retracted position. The puff of gas is sufficient to slightly billow the web of paper so that free ends of the blades avoid contacting transverse fold edges of the paper as the blades reach their extended position.

It is to be appreciated that the apparatus of the preferred embodiment can be built without the auxiliary paper tractor drive means, thereby enabling the apparatus to slide into the recessed output paper stacking region (i.e., the stacking bin) of a printer.

In the manner described, the method of extending and retracting the paper supporting blades offers a space-saving benefit that conforms to the limited space within the recessed output stacking region of the printer. It is also to be appreciated that with such modifications, the apparatus of the present invention can be built into the framework of the printer.

In the manner described, the paper handling apparatus of the present invention enables the automated stacking of a continuous web of Z-fold computer paper into a number of interconnected stacks.

BRIEF DESCRIPTION OF THE DRAWINGS

The present invention can be more readily understood by a consideration of the following detailed description when taken in conjunction with the accompanying drawings, in which:

FIG. 4 is a longitudinal cross sectional drawing looking along line 4—4 of FIG. 3, showing a representative one of the intermediate stacking blades in its extended position and showing an associated motor for pivotally moving the blade between its extended and retracted positions;

FIG. 5 is a transverse cross sectional drawing looking along line 5—5 of FIG. 3, showing all of the stacking blades in their extended condition, showing their operating motors and showing means for causing vertical movement of the stacking blade assembly between its upper and lower positions;

FIG. 6 is a transverse cross sectional drawing similar to FIG. 5 and looking along the same line 5—5 of FIG. 3, but showing the stacking blades in their retracted position in which the blades overlap one another;

FIG. 7 is a transverse cross sectional drawing looking along line 7—7 of FIG. 3, showing a drive chain and sprocket gears associated with a drive motor for causing vertical movement (i.e., elevation and de-elevation) of the stacking blade assembly between its upper and lower positions;

FIG. 8 is a vertical cross sectional drawing looking along line 8—8 of FIG. 3, showing the drive motor and associated drive chains and sprockets for causing movement of the stacking blade assembly between its upper and lower positions;

FIG. 9 is a transverse cross sectional drawing looking along line 9—9 of FIG. 3, showing drive means for operating the auxiliary tractor drive portion of the apparatus;

FIG. 10 is a plan view, partially cutaway, looking along line 10—10 of FIG. 2, of the conveyor portion of the paper handling apparatus shown in FIG. 1, showing a conveyor belt assembly having a plurality of laterally-separated conveyor belts, a motor connected for driving the belts in unison and showing a Z-fold paper stacking region at one end of the belts which is intended to be adjacent to an associated printer and showing a stacked paper removing position at the opposite end of the conveyor belts;

FIG. 11 is a transverse cross sectional drawing looking along line 11—11 of FIG. 10, showing open regions between end regions of the conveyor belts at the paper stacking position to enable the stacking blades in their extended position to pass between the end regions of the belts as the blades are de-elevated to their lower position;

FIG. 12 is a transverse cross sectional drawing looking along line 12—12 of FIG. 10, showing the conveyor drive motor connected for driving all of the conveyor belts in unison;

FIG. 14 is a series of diagrams of the paper handling apparatus of FIG. 1, illustrating the sequential operation thereof:

FIG. 15 is a side elevational view of a variation Z-fold computer paper handling apparatus that differs from the paper handling apparatus depicted in FIGS. 1 and 2 only in that the auxiliary tractor drive is not used, the paper receiving end region of the apparatus being shown received or built into what would be the stacked paper bin of a printer similar to that depicted in FIGS. 1 and 2; and FIG. 16 is a partially cut-away perspective drawing of a variation intermediate paper stacking means showing fixed stacking blades and showing the manner in which the stacking blades are moved between their paper-intercept, extended position and their out-of-the-way, retracted position.

In the various FIGS. identical elements and features are given the same reference number.

DETAILED DESCRIPTION OF THE INVENTION

Figure 1:
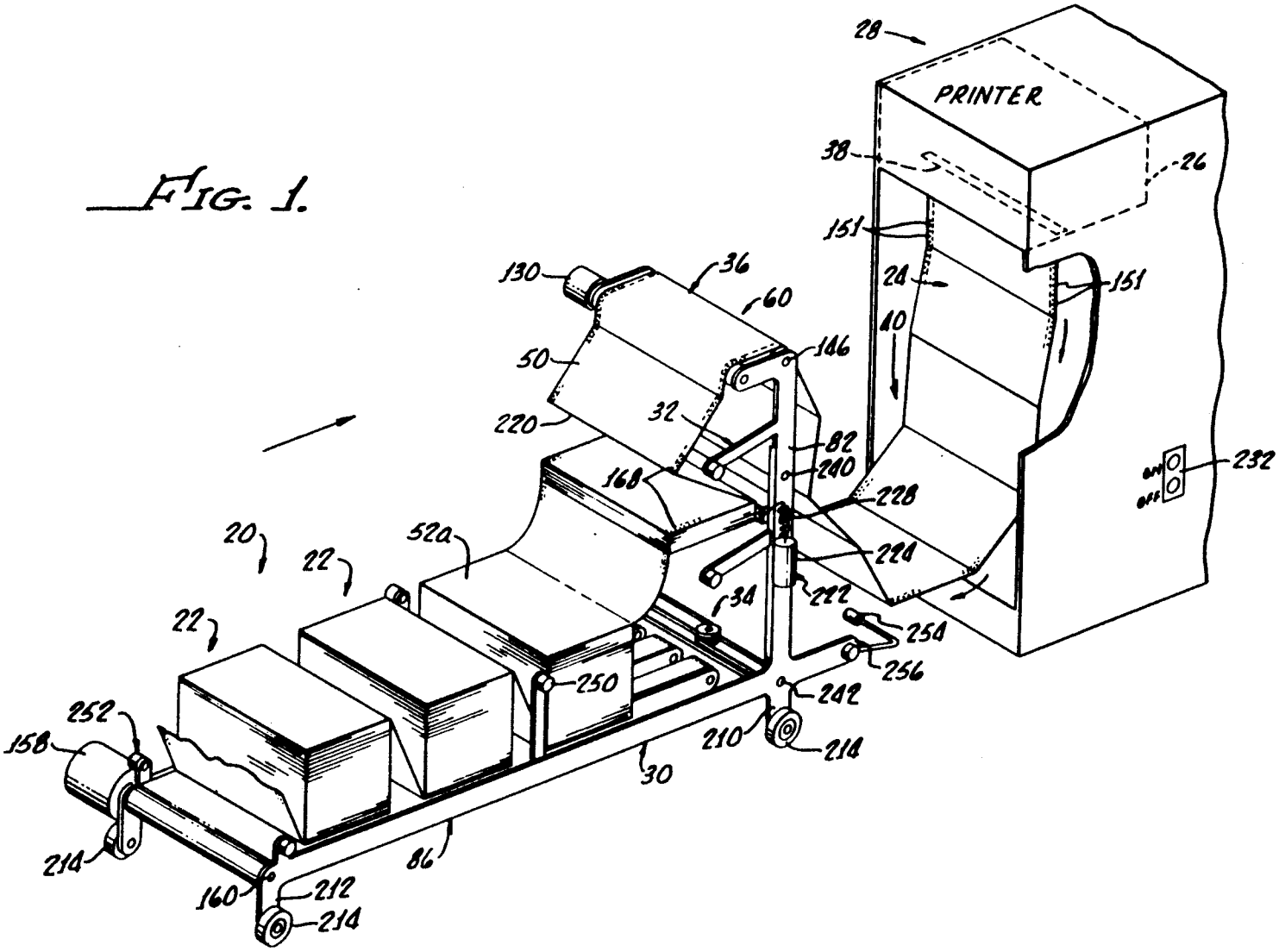
FIG. 1 is a perspective drawing of one embodiment of a Z-fold computer paper handling apparatus according to the present invention, the apparatus being shown positioned for receiving a continuous web of printed Z-fold computer paper from a generally conventional, preexisting printer associated with a computer and for causing the stacking of such web into interconnected stacks of computer paper on a conveyor portion of the apparatus.
Figure 2:
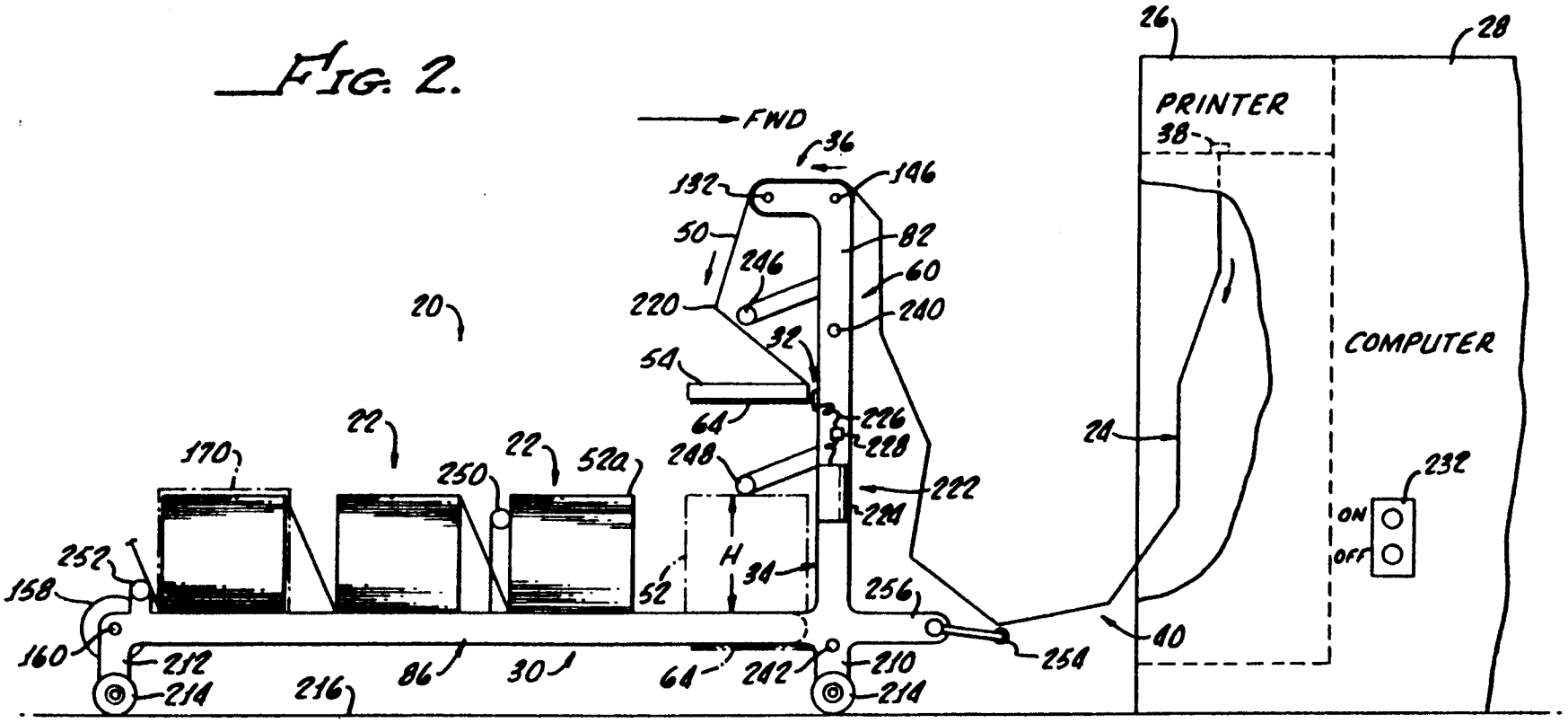
FIG. 2 is a side elevation view of the Z-fold computer paper handling apparatus of FIG. 1, showing the manner in which a continuous web of computer paper is received from the printer and is stacked in several interconnected stacks of paper on the conveyor portion of the apparatus.

There is shown in FIGS. 1 and 2 a handling apparatus 20, in accordance with the present invention, for enabling the stacking and conveying of interconnected stacks 22 of paper formed from a continuous web 24 of Z-fold computer paper received from an associated computer printer 26 (shown in phantom lines) which may be part of an computer system 28 (only partially shown) with which the paper handling apparatus. As more particularly described below, paper handling apparatus 20 comprises generally conveyor means 30, intermediate stacking means 32, elevating means 34 and auxiliary tractor paper drive means 36.

Also as more particularly described below, Z-fold paper web 24 after being discharged from a printer discharge port 38 (shown in phantom lines) passes onto auxiliary tractor drive means 36, forming an open or partial loop 40 between the printer discharge port and the auxiliary tractor drive over which paper web 24 is drivingly entrained so as to enable the paper to be pulled from printer 28.

From auxiliary tractor drive 36, a section 50 of paper web 24 cascades downwardly toward a stacking position or region 52 (shown in phantom lines on FIG. 2) on conveyor means 30 where it stacks normally in a back-and-forth motion. Intermediate stacking means 32, in combination with elevating means 34, causes the forming of a short intermediate stack 54 of web portion 50 above conveyer stacking region 52 whenever a stack 22 forming at conveyor stacking region 52 reaches a preestablished height, H, (FIG. 2) and is moved by conveyor means 30 to a next, downstream stack position 52*a* so that a next stack can accumulate at the conveyor stacking region.

Figure 3:
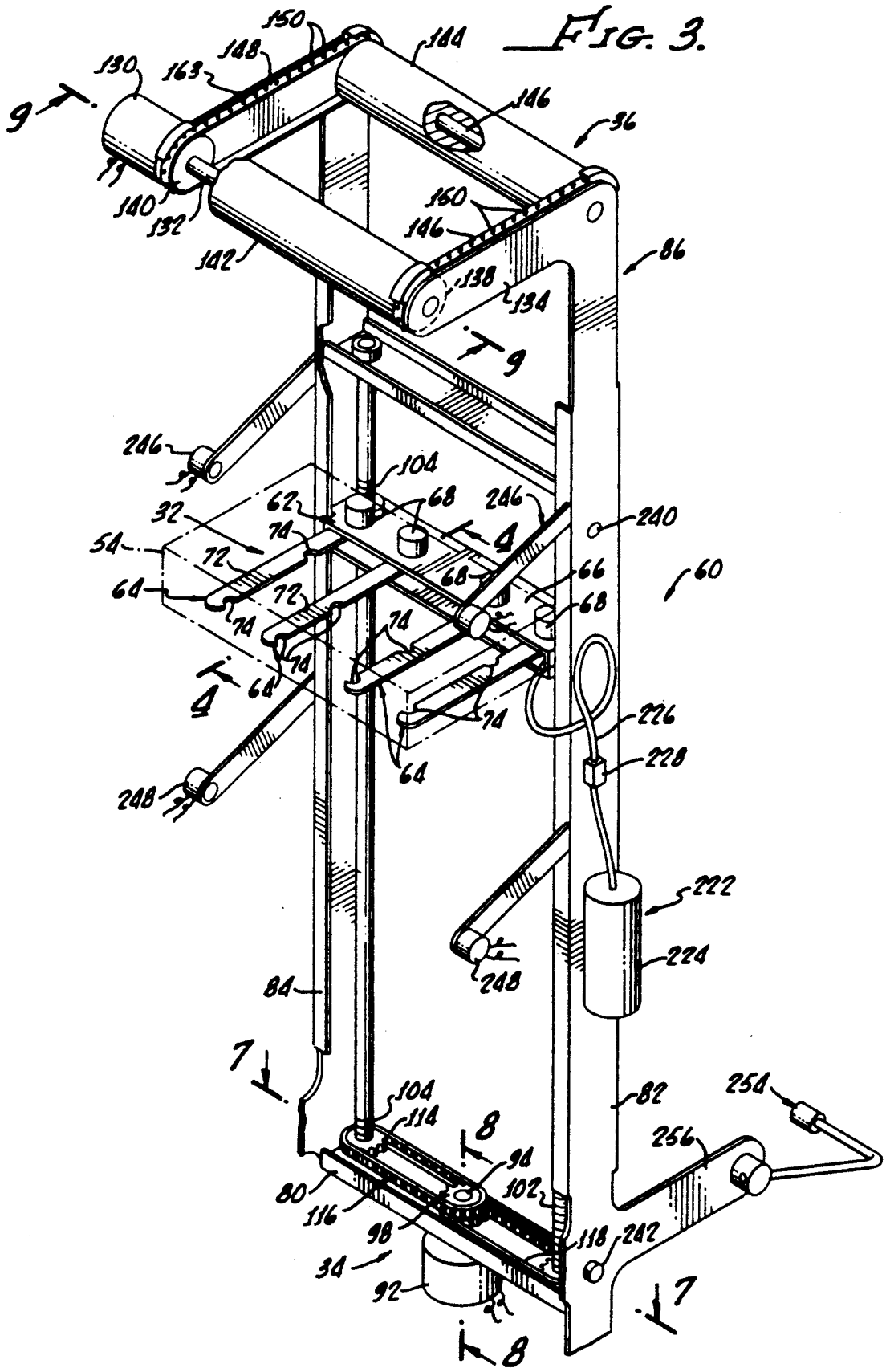
FIG. 3 is a perspective drawing, partially cutaway, of an intermediate stacking portion of the Z-fold paper handling apparatus of FIGS. 1 and 2, showing an auxiliary tractor drive portion of the apparatus and showing a plurality of intermediate stacking blades positioned in their extended position for intercepting the web of computer paper between the auxiliary tractor drive portion and a paper stacking region of the conveyor.

Intermediate stacking means 32, elevating means 34 and auxiliary tractor drive 36 are more particularly shown in FIG. 3 and in combination form an important part 60 of apparatus 20. Intermediate stacking means 32 comprises a blade assembly 62 which includes a plurality of similar, elongate, slender blades 64, a transverse, C-channel blade housing 66 and a plurality of blade actuation motors 68--one operatively connected to each of the blades by means of a short shaft 70 which extends vertically through blade housing 66 (FIGS. 4 and 5).

The use of four blades 64 is depicted in FIGS. 3 and 5 and is preferred, the blades being long, slender and relatively thin. For example, with no limitation being thereby intended or implied, each of blades 64 may be about 12 inches long, about 1 inch wide and about 1/16 of an inch thick and may be advantageously constructed of hard aluminum alloy or stainless steel. Blades 64 may be beveled along leading edges 72 (FIG. 3) so that they can smoothly intercept paper web portion 50.

Blades 64 are arranged on their associated shafts in a side by side relationship and when extended, as illustrated in FIGS. 3 and 5, are mutually parallel and are at right angles relative to housing 66. The spacing between adjacent pairs of blades 64 may be about 3 to 4 inches. Further, blades 64 are, as shown in FIGS. 5 and 6, vertically staggered an amount just sufficient to avoid interference with one another during their movement between their retracted position shown in FIG. 6 and their extended position shown in FIGS. 3–5. As shown in FIG. 6, blades 64, when in their retracted position overlap one another and are nested in housing 66 much like multiple blades in common pocket knives. Each blade 64 is formed having spaced apart notches 74 (FIG. 3) to provide clearance for adjacent blade mounting shafts 70 when the blades are in their retracted position.

Operating motors 68 are preferably miniature stepping motors which can provide precise 90 degree pivotal movement of their associated blades 64 between the retracted and extended positions.

One manner in which vertical movement (i.e., de-elevating and elevating) of blade assembly 62 between a first, upper position (depicted in FIG. 3) and a second, lower position (indicated in FIG. 2 by a blade 64 shown in phantom lines beneath conveyor means 30) is achieved by elevating means 34 as is illustrated in FIGS. 3, 7 and 8. As shown, elevating means 34 comprises a transverse C-channel member 80 that is connected between transversely spaced apart vertical side rails 82 and 84 which form a part of a frame 86 of apparatus 20. Attached to member 80, in a central region, is a motor 92 having a drive shaft 94 that extends upwardly through a bottom portion 96 of the member (FIG. 8). First and second sprockets 98 and 100 are non-rotatably fixed to shaft 94 above bottom portion 96.

First and second, elongate screw shafts 102 and 104 are rotatably mounted in a vertical orientation through opposite end regions of both member 80 and a corresponding C-channel member 106 that is transversely mounted between side rails 82 and 84 above the upper position of intermediate stacking means 32 (FIG. 3), screw shaft 102 being behind side rail 82. Screw shafts 102 and 104 extend through respective threaded elements 110 and 112 that are non-rotatably fastened to opposite end regions of blade housing 66 (FIGS. 5 and 6).

Rotation of screw shafts 102 and 104 in unison in on& direction thus causes intermediate stacking means 32 (which includes housing 66 and blades 64) to elevate relative to lower member 80 toward the upper position of the intermediate stacking means and rotation of the screw shafts in the opposite direction causes the intermediate stacking means to de-elevate relative to the lower member--that is, to move downwardly toward the lower position of the intermediate stacking means.

Rotation of screw shaft 104 is enabled by a sprocket 114 fixed to lower regions of the shaft above bottom portion 96 of lower member 80 (FIGS. 3 and 7) . A drive chain 116 entrained over sprocket 114 and over corresponding sprocket 98 fixed to motor shaft 94 transmits rotary movement of the motor shaft to screw shaft 104. Similarly, a corresponding drive chain 118 is entrained over motor shaft sprocket 100 and over a sprocket 120 fixed to lower regions of first screw shaft 102 to impart rotary motor shaft movement to such screw shaft in unison with rotary movement of second screw shaft 104.

Motor 92 is thus operative for elevating intermediate stacking means 32 between its lower and upper positions and de-elevating the intermediate stacking means from its upper to its lower positions, according to the direction in which motor shaft 94 is rotated by motor 92. On the other hand, motors 68 are operable for rotating blades 64 through about 90 degrees for movement between the extended and retracted blade positions.

As shown in FIGS. 3 and 9, auxiliary tractor drive means 36 comprises a tractor drive motor 130 having a drive shaft 132 which extends through rearwardly-directed regions 134 and 136 of respective side members 82 and 84 and to which are non-rotatably fixed first and second, laterally spaced apart drive wheels 138 and 140 that are positioned inside adjacent the side members. Drive shaft 132 is preferably located so as to be centered above conveyor stacking region 52 (FIG. 2). A paper support roller 142 is rotatably mounted over drive shaft 132 and extends laterally between drive wheels 138 and 140.

An idler roller 144 is mounted on an idler shaft 146 that is mounted forwardly of and parallel to drive shaft 132 between side members 82 and 84 (FIG. 3). First and second studded paper drive belts 146 and 148 are entrained over respective drive wheels 138 and 140 and idler roller 146. Drive wheels 138 and 140 are laterally spaced apart on drive shaft 132 a distance, D (FIG. 9), such that studs 150 on drive belts 146 and 148 engage drive holes 151 (FIG. 1) along side edges of paper web 24. Drive motor 130 is thus operative for pulling paper web 24 from open loop 40 over auxiliary drive means 36 so that paper in the web can stack onto stacking region 52 of conveyor means 30.

Conveyor means 30, as shown in FIGS. 10–12, comprises first, second and third, spaced-apart conveyor belts 152, 154 and 156, respectively, which are driven by a conveyor motor 158, through a common drive shaft 160 and corresponding first, second and third drive rollers or wheels 162, 164 and 166 over which the belts are individually entrained (FIG. 12). Common shaft 160 is rotatably mounted through side members 82 and 84. A stack removal region 170 (shown in phantom lines in FIG. 10) is located just forwardly of drive shaft 160 at the aft (distal) end of conveyor means 30.

At the other (proximal) end of conveyor means 30, respective first, second and third conveyor belts 152, 154 and 156 are entrained over corresponding idler rollers 172, 174 and 176 which are, in turn, mounted on individual idler shafts 178, 180 and 182 (FIG. 11). As shown in FIGS. 10 and 11, idler shafts 178, 180 and 184 are rotatably mounted in transverse, but spaced apart, alignment to a fork-shaped region 184 of a conveyor bottom plate 186 that extends between side members 82 and 84. Thus., idler shaft 178 is mounted to a U-shaped channel region 190; idler shaft 180 is mounted to a U-shaped region 192 and idler shaft 182 is mounted to a U-shaped region 194 (FIG. 11).

As seen in FIG. 10, there is a first space 200 between one end of idler shaft 178 and side member 82, a second space 202 between the other end of shaft 178 and the adjacent end of shaft 180, a third space 202 between the other end of shaft 180 and the adjacent end of shaft 182 and a fourth space 206 between the other end of shaft 182 and side member 84. These spaces 200, 202, 204, 206 and 208 are preferably of about equal width and length and are selected to enable the passage of blades 64 in their extended position when intermediate stacking means 32 is de-elevated from its upper position to its lower position during operation of apparatus 20. Stacking region 52 is located at this proximal end of conveyor means 30 so that when blades 64 pass downwardly through spaces 200–208, intermediate stack of paper 54 supported on the blades is deposited onto belts 152, 154 and 156 at stacking region 52.

It will be appreciated that although three conveyor belts 152, 154 and 156 have been described as comprising conveyor means 30, second belt 154 or first and third conveyor belts 152 and 156 could be replaced with idler belts or with sets of idler rollers, both as are known to those skilled in the appropriate art.

Conveyor means 30 includes proximal and distal legs 210 and 212 (FIGS. 1 and 2), only those associated with side member 82 being seen. Advantageously, legs 210 and 212 terminate in lockable wheels 214 which enable apparatus 20 to be easily moved about on a floor 216 (FIG. 2), for example, from one printer 26 to another, as may be desired.

Although a malfunction caused by blades 64 hitting a fold line 220 (FIGS. 1 and 2) between adjacent sheets of Z-fold paper when the blades are pivoted to their extended position by motors 68 is very unlikely, there may, nevertheless, be provided compressed gas means 222 (FIG. 3) for providing a puff of compressed gas, e.g.,, air or nitrogen, directed toward the paper web impact region of the blades as they are pivoted to their extended position by motors 68. Comprising compressed gas means 222 are a compressed gas bottle 224, a compressed gas conduit or tube 226 and an electrically-operated "on-off" valve 228.

There has been described above, in conjunction with various of the FIGS. , a number of drive motors, i.e., blade pivoting motors 68, elevating motor 92, auxiliary tractor drive motor 130 (e.g., FIG. 3) and conveyor drive motor 158 (e.g., FIG. 10), and electrically-operated compressed gas valve 228 (FIG. 3). In order for apparatus 20 to operate in its intended manner, these mentioned motors and valve are, in accordance with the present invention, automatically operated in particular sequences and manners. To enable such automatic operation, a microprocessor 230 (FIG. 13) is included in apparatus 20.

Inputs to microprocessor 230 are the electrical inputs from the various sensors described below; outputs are to motors 68, 92, 130, 158, valve 228 and a printer "on/off" switch 232 (FIGS. 1 and 2). The sensors that provide the electrical inputs to microprocessor 230 include intermediate stacking means upper position sensor 240 and lower position sensor 242 that are mounted on side member 82 (FIGS. 1-3). Both sensors 240 and 242 may, for example, comprise Hall-effect switches which respectively provide electrical output signals indicating when blade housing 66 reaches (and is at) its upper position and reaches (and is at) its lower position. Thus, by means of signals from sensors 240 and 242, microprocessor 230 always "knows" the position of the blade assembly comprising blades 64 and housing 68.

The sensors further include electro-optical sensors 246 and 248 that are mounted in operative pairs to side members 82 and 84 (FIG. 3) and which respectively establish the stack height of intermediate stack 54 formed on extended blades 64 and the height of a full stack of computer paper formed at computer stacking region 52. Sensors 246 and 248 thus signal microprocessor 230 when intermediate paper stack 54 formed on blades 64 has reached its preestablished height limit (which may be only 20 or so sheets) and when the paper stack formed at stacking region 52 has reached its preestablished height limit (which may be several thousand sheets). The height of intermediate paper stack 54 is established by the time required by conveyor means 30 to move a just-formed paper stack in stacking region 52 from such position to a next downstream position **52*a* (FIGS. 1 and 2). Thus, as an alternative to sensor 246 which senses the height of paper stack 54, microprocessor may establish a time permitted for such paper stack movement from positions 52 to 52*a* and cause the de-elevating operation of motor 92** when the established time has run.

Electro-optical sensors 250 and 252 are mounted in operative pairs to side members 82 and 84 (FIGS. 1 and x2) in positions providing electrical output information respectively when a paper stack on conveyor means 30 has just reached a preestablished second stack position that is one stack position removed from a stack at stacking region 52 and when an end stack has reached a preestablished end stack position at stack removal region 170.

In addition,, a paper loop proximity sensor 254 is mounted to side member 82 at a forward extension 256 thereof (FIGS. 1-3). Sensor 254, which may, for example, be a type 67-21A sensor available from Garrett Corporation, of Los Angeles, Calif. provides an analog electrical signal which relates to the closeness of web loop 40 to the sensor. Accordingly, sensor 254 provides electrical information to microprocessor 230 when paper loop 40 is too slack (i.e., is too close to the sensor) or is not slack enough (i.e., is too far from the sensor) as compared to a preestablished standard loop position.

Responsive to electrical signals from blade position sensors 240 and 242, stack height sensors 246 and 248, conveyor stack positions 250 and 252 and paper loop position sensor 254, microprocessor 230 operates blade operating motors 68, blade elevating motor 92, auxiliary tractor drive motor 130, conveyor belt drive motor 158, compressed air valve 228 (if used) and printer switch 232 in accordance with programmed instructions (as described below).

Figure 13:
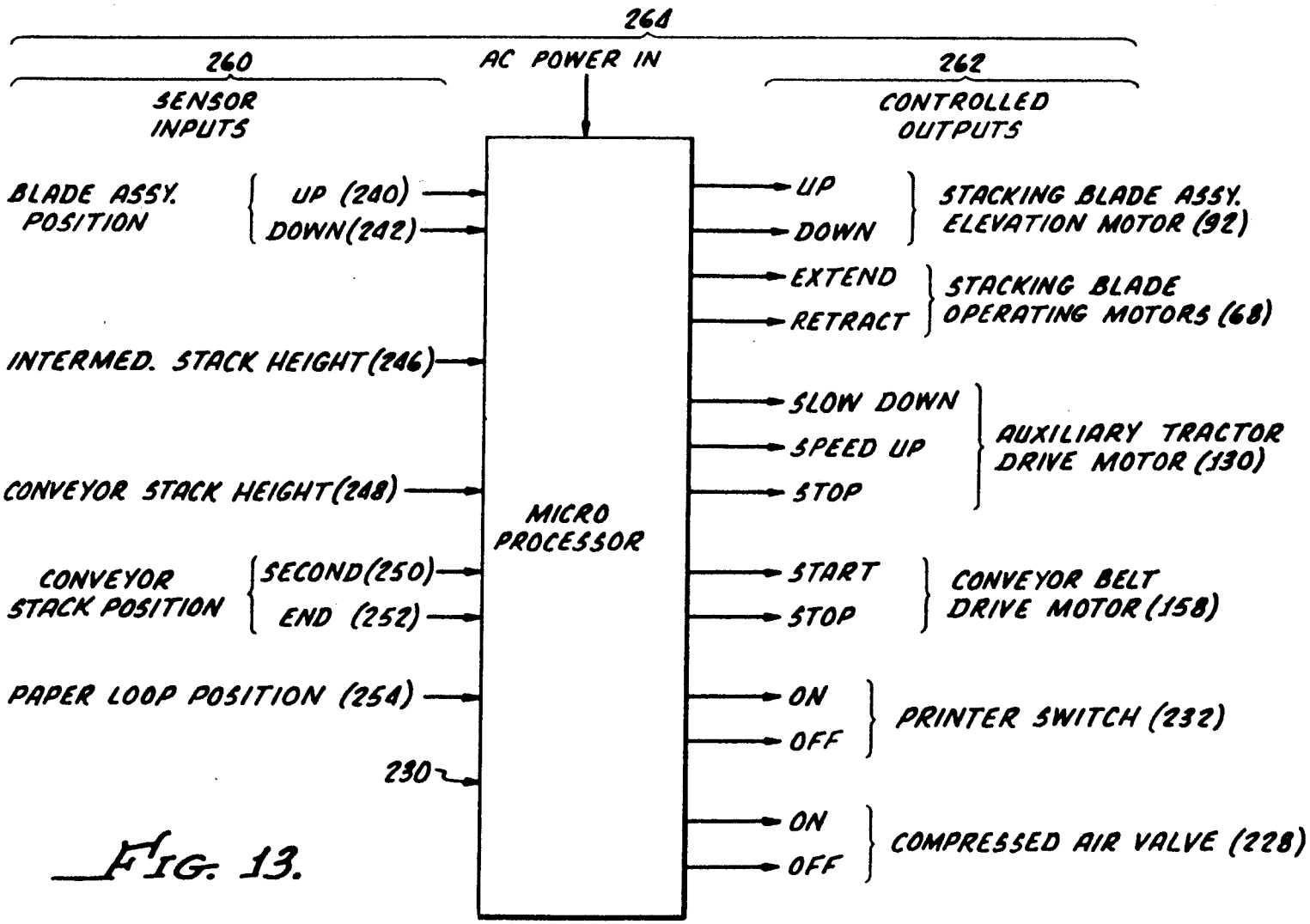
FIG. 13 is a functional representation of the control system for the paper handling apparatus of FIG. 1, showing a microprocessor and the various sensor inputs thereto and the associated output control functions.

Collectively, sensors 240, 242, 246, 248, 250, 252 and 254 may be considered to comprise sensor or sensing means 260 (FIG. 13). Collectively, motors 68, 92, 130 and 158, switch 232 and valve 228 may be considered to comprise operating means 262. Moreover, sensor means 260, operating means 262 and microprocessor 230 may be considered to comprise control means 264 (FIG. 13).

OPERATION

FIG. 14 illustrates, in diagramatic form, a sequence of operating steps of paper handling apparatus 20. FIG. 14A depicts apparatus 20 shortly after its start-up. Intermediate paper stacking means 32 is "parked" at its upper position with blades 64 in their retracted position. This upper position of intermediate stacking means 32 is sensed by sensor 240. The continuous web of Z-fold computer paper is shown as folding back and forth in a normal manner as it reaches conveyor stacking region 52, the paper cascading downwardly onto stack 22 as the paper leaves auxiliary tractor drive 36.

The computer paper continues to stack in the above-described manner onto stacking position 52 until sensor 248 senses that the preestablished stack height, H, has been reached. When this stack height is sensed by sensor 248, blades 64 are caused to pivot from their retracted to their extended position (by motors 68) and thereby intercept portion 50 of paper web 24 substantially above the top of the just-formed paper stack on conveyor stacking region 52 (FIG. 14B) The intercepted paper will now start to form an intermediate stack 54 on extended blades 64.

Figure 14A:
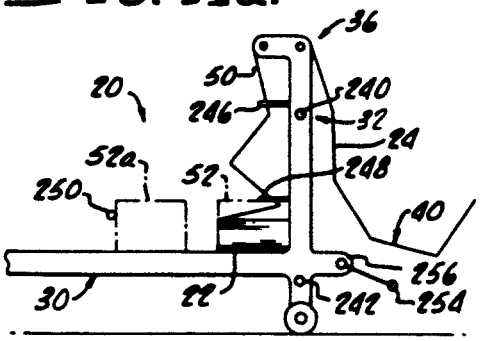
FIG. 14A showing start-up operating of the Z-fold computer paper stacking apparatus during which paper is stacked in a normal back-and-forth (zig-zag) manner onto the stacking position of the conveyor portion from the auxiliary tractor drive, and showing the stacking blade assembly in its upper position with the stacking blades in their retracted position.
Figure 14D:
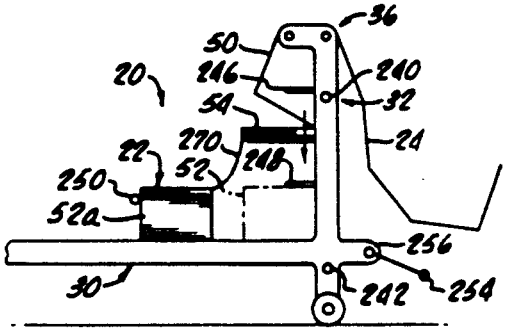
FIG. 14D (which is similar to FIG. 2) shows the just-formed stack of paper on the conveyor having been conveyed to the next-adjacent position closer to the stack removing position and showing the stacking blade assembly, with a short, intermediate stack of paper formed thereupon, being moved downwardly toward the stacking region of the conveyor so as to enable the deposit of the intermediate stack of paper thereonto.
Figure 14B:
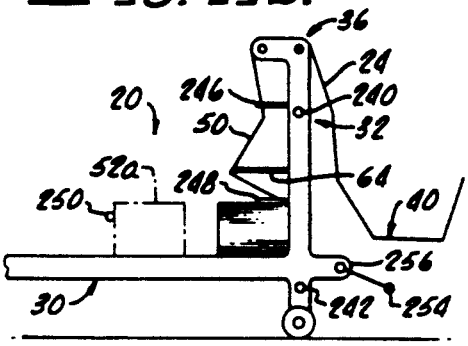
FIG. 14B showing the condition in which the stack of paper being stacked onto the conveyor has reached a preestablished height and thereby causing the stacking blades to be operated to their extended position so as to intercept the web of computer paper between the auxiliary tractor drive and the stacking position on the conveyor so that the computer paper from the auxiliary tractor drive starts to stack on the blades and stops stacking on the stack of paper on the conveyor.
Figure 14E:
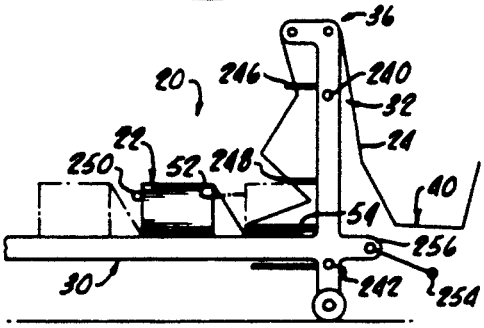
FIG. 14E showing the stacking blade assembly having been moved to its lower position below the conveyor stacking region and the computer paper from the auxiliary tractor drive now stacking onto the intermediate stack of paper that has been deposited onto the conveyor at the stacking position by the extended stacking blades—at this point in operation of the apparatus the stacking blades is normally retracted and the blade assembly elevated back to its uppermost position as shown in FIG. 14A for the next cycle of operation.
Figure 14C:
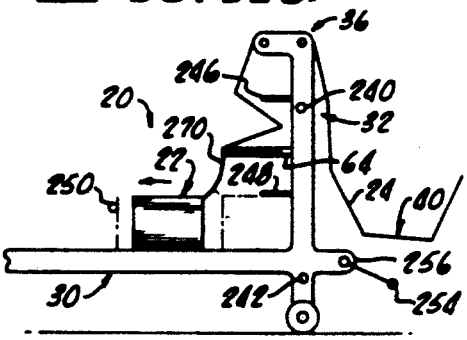
FIG. 14C shows the computer paper from the auxiliary tractor means stacking on the extended stacking blades and shows the conveyor actuated so as to convey the just-formed stack of paper from the conveyor stacking region to a next-adjacent downstream position closer to the stack removing position on the conveyor.

As shown in FIG. 14C, as the Z-fold computer paper from auxiliary tractor drive 36 begins to form a stack 54 on extended blades 64, conveyor means 30 is actuated (through motor 158) so as to move the just-formed stack 22 away from stacking region 52. This stack movement is accomplished without breaking a paper web portion 270 between the top of just-formed stack 22 and the bottom of intermediate stack 54.

Operation of conveyor means 30 is coordinated with the stack-forming rate on extended blades 64 so that just formed stack 22 is moved to a downstream, next conveyor position **52*a* (as is sensed by sensor 250, conveyor means 30 being thereby caused to stop) by the time intermediate stack 54 reaches its preestablished height, as determined by sensor 246. When this preestablished stack height of stack 54 is reached, intermediate stacking means 32 is de-elevated (by motor 92) toward the lower position of the intermediate stacking means (FIG. 14D**).

As intermediate stacking means 32 is de-elevated toward its lower position, extended stacking blades 64 pass vertically through conveyor stacking region 52 (that is, the blades pass between and to sides of conveyor belts 152, 154 and 156 (FIG. 10) . As blades 64 pass downwardly through conveyor stacking region 52, the short stack 54 of paper carried on the blades is deposited (i.e., left behind) on the stacking region (FIG. 14E). This downward movement of intermediate stacking means is accomplished at a rate assuring that the paper web between intermediate stack 54 and auxiliary tractor drive means 36 is not broken or torn.

When intermediate stacking means 32 reaches its lower position, as detected by sensor 242, downward movement of the intermediate stacking means is stopped. Blades 64 are then caused to be pivoted to their retracted position and the intermediate stacking means is elevated to its upper position (sensed by sensor 240) and is parked there until the next stack forming on conveyor stacking region reaches its preestablished height, H, at which time the above-described cycle is repeated until the first-formed paper stack reaches stack removal region 170 at the distal end of the conveyor means (as detected by sensor 252, FIG. 2). If the end stack is not removed from this removing region 170 within a preestablished time interval, microprocessor 130 turns off printer switch 232 so that the flow of paper from printer 26 is stopped.

During the described operating cycle, paper loop 40 is kept constant: if sensor 254 senses the loop is slackening, auxiliary drive means 36 is speeded up (by motor 130). Conversely, if paper loop becomes less slack than permitted, auxiliary tractor drive motor 130 is slowed down by microprocessor 230.

VARIATION OF FIG. 15

There is depicted in FIG. 15 a variation Z-fold computer paper handling apparatus 20*a* which can be seen—by comparing FIG. 15 with FIG. 2—as being identical to above-described apparatus 20 except that auxiliary tractor drive means 36 is omitted, as is paper sensor 254 and side member portion 256 to which the sensor is attached. Otherwise, it can be seen that forward regions of apparatus 20*a* are received—or built into—a paper bin region 280 of printer 26. As such, blades 64 when in their extended position are directly below paper discharge region 38 of printer 26, as is paper stacking region 52 of conveyor means 30A. Further description of apparatus 20 is, therefore, not considered to be necessary.

The operation of apparatus 20*a* is identical to that described above for apparatus 20 except that being partially installed or built into paper bin 280, there is no need for auxiliary tractor drive means 36 or for paper sensor 254.

VARIATION OF FIG. 16

FIG. 16 depicts a variation intermediate stacking means 32*a* which is similar to above-described intermediate stacking means 32 (as best seen in FIG. 3) except that blades 64*a* are rigidly (i.e., non-pivotally) fixed to a transverse member 66*a* which corresponds to blade housing 66. The assembly comprising blades 64*a* and member 66*a* is elevated and de-elevated between its upper and lower positions in the manner and by the same elevating means 34 that has been described above for the corresponding blade assembly comprising blades 64 and blade housing 66—that is, by motor 92 driving first and second vertical screw shafts 102 and 104 that extend through end regions of member 66*a*.

Movement of blades 64*a* between their extended and retracted positions is provided by horizontal moving means 282 that is virtually identical to elevating means 34 except for operating in a horizontal rather than in a vertical plane. Thus, a motor 284 drives first and second horizontal screw shafts 286 and 288 which extend through lower end regions of side members 82*a* and 84*a*. Such driving is through sprockets and chains (not shown) in the manner described above relative to elevating means 34. Sensors 290 and 292 provide signals to microprocessor 230 indicating when members 82*a* and 84*a* are positioned so that blades 64*a* are in their respective extended and retracted positions. Such movement of fixed blades 64*a* between their extended and retracted positions is operationally the same as the pivotal movement described above for blades 64.

Although there has been described and illustrated a Z-fold computer paper handling apparatus and variations thereof in accordance with the present invention for purposes of illustrating the manner in which the invention may be used to advantage, it is to be appreciated that the invention is not limited thereto. Therefore, any and all variations and modifications that may occur to those skilled in the computer printing and computer paper handling art are to be considered as being within the scope and spirit of the claims as appended hereto.

What is claimed is:

1. Apparatus for handling a continuous web of Z-fold computer paper as it is discharged from a printer, said apparatus comprising:

a. conveyor means having a Z-fold paper stacking region positionable relative to said printer for receiving a continuous web of Z-fold computer paper discharged therefrom and for permitting said received paper to stack in a normal manner, and having a spaced apart Z-fold stack removing position from which stacks of Z-fold paper formed on the conveyor means are removed;

b. a plurality of stacking blades movable between an extended position and a retracted position;

c. elevating means for causing said blades to move between a first, upper position above the conveyor stacking in which the blades in their extended position are positioned above said stacking region of the conveyor means and intercept a stream of Z-fold computer paper from the printer so as to enable the paper to form an intermediate paper stack on the blades and in which the blades in their retracted position are positioned so as not to intercept said stream of Z-fold paper, and a second, lower position below the conveyor stacking region, said blades and conveyor means being relatively configured such that when the blades in their extended position are moved from their upper position to their lower position, an intermediate stack of paper formed on the blades is deposited onto said stacking region; and d. operating means responsive to a stack of paper forming on said stacking region reaching a preestablished height for causing, in sequence:

(1) the elevating means to have the blades at their first, upper position and in their retracted position, (2) the blades to move from their retracted position to their extended position so as to enable the intercepted stream of paper to start stacking on said blades, (3) the conveyor means to move the just-formed stack of Z-fold paper out of the way of a next stack of paper to be stacked at said stacking region, and (4) the elevating means to move the extended blades to their lower position so that the intermediate stack of paper is deposited from the extended blades onto the stacking region of the conveyor means, so as to enable a next stack of Z-fold paper to stack onto said intermediate stack as the next stack on the stacking region.

2. The Z-fold computer paper handling apparatus as claimed in claim 1, wherein the stacking region of the conveyor means is configured so as to enable the blades in their extended position to pass vertically therethrough as they pass from their upper to their lower positions.

3. The Z-fold computer paper handling apparatus as claimed in claim 1, wherein said plurality of blades includes at least four blades, and wherein said blades move in a generally horizontal plane between their retracted and extended positions.

4. The Z-fold computer paper handling apparatus as claimed in claim 1, wherein blades are pivotally mounted for rotation through about 90 degrees between their retracted position and their extended position.

5. The Z-fold computer paper handling apparatus as claimed in claim 1, wherein the preestablished height of the intermediate stack of Z-fold paper formed on said blades is substantially less than the preestablished height of the stack of Z-fold paper forming on said stacking region of the conveyor means.

6. The Z-fold computer paper handling apparatus as claimed in claim 1, including position sensing means for sensing when said stack of Z-fold paper forming at said stacking position has reached its preestablished height and when said intermediate stack of Z-fold paper formed on said extended blades reaches its preestablished height.

7. The Z-fold computer paper handling apparatus as claimed in claim 6, wherein said position sensing means further include means for sensing when the conveyor means has moved a stack of Z-fold paper from said stacking region toward said stack removing region a distance sufficient to permit the extended blades to deposit their intermediate stack of Z-fold paper onto said stacking region without interference with the stack of previously-stacked paper.

8. The Z-fold computer paper handling apparatus as claimed in claim 6, wherein said operating means are responsive to signals from said position sensing means.

9. The Z-fold computer paper handling apparatus as claimed in claim 1, including auxiliary Z-fold computer paper drive means adapted to be disposed between said printer and said uppermost position of said blades.

10. The Z-fold computer paper handling apparatus as claimed in claim 9, including paper position sensing means adapted to be disposed between said auxiliary drive means and said printer, said paper position sensing means being configured for sensing when a partial loop of computer paper formed between the printer and auxiliary drive means is larger or smaller than a preestablished size.

11. The Z-fold computer paper handling apparatus as claimed in claim 10, wherein said operating means are responsive for speeding the operation of said auxiliary paper drive means when said partial loop of computer paper is sensed to be too large and for slowing operation of said auxiliary paper drive means when the partial loop of computer paper is sensed to be too small.

12. The Z-fold computer paper handling apparatus as claimed in claim 1, including means for sensing when the conveyor means has moved a stack of Z-fold paper to said stack removing position.

13. The Z-fold computer paper handling apparatus as claimed in claim 12, including means adapted for turning said printer off when a stack of Z-fold paper reaches said stacking removing position and is not removed therefrom in a preestablished time.

14. The Z-fold computer paper handling apparatus as claimed in claim 1, wherein the printer is built into a housing and wherein at least portions of said apparatus are also built into said housing.

15. The Z-fold computer paper handling apparatus as claimed in claim 1, including means for directing a puff of compressed gas toward said web of computer paper in the region of said blades as the blades are moved into their extended position from their retracted position, said puff of gas being sufficient to slightly billow the web of paper so that free ends of the blades avoid contacting transverse fold edges of the paper as the blades reach their extended position.

16. Apparatus for handling a continuous web of Z-fold computer paper as it is discharged from a printer, said apparatus comprising:

a. conveyor means having spaced apart Z-fold paper stacking and stacked paper removing regions, said stacking region being positionable relative to said printer for receiving a continuous web of Z-fold computer paper discharged therefrom and for permitting said received paper to stack thereon, said conveyor means including a conveyor and means for driving the conveyor in a direction causing a stack of Z-fold paper in said stacking region to be conveyed toward said paper stack removing region;

b. temporary stacking means, including a plurality of stacking blades and blade actuating means for causing movement of the blades in a generally horizontal plane between an extended position and a retracted position;

c. elevating means for causing the temporary stacking means to move between an uppermost position in which said blades in their extended position are positioned directly above said stacking region and are in a position to intercept a stream of Z-fold computer paper from the printer before the paper reaches the stacking region of the conveyor means to thereby enable the paper to form an intermediate paper stack on the blades and when the blades are in their retracted position they are positioned so as not to intercept said stream of Z-fold paper, and a second, lower position in which the blades are below the stacking region; and d. operating means connected to said conveyor drive means, said means for causing lateral movement of said blades and said elevating means for causing, in response to a stack of Z-fold paper forming on said stacking region reaching a preestablished height, in sequence:

(1) said elevating means to locate the temporary stacking means at its uppermost position and the blade actuating means to position said blades in their retracted position, (2) said blade actuating means to move the blades from their retracted position to their extended position so as to cause the blades to intercept said stream of paper from the computer, without breaking the web of paper, so as to enable the stream of paper to start stacking on said blades, (3) said conveyor means to drive the conveyor a preestablished distance causing the stack of Z-fold paper last formed at the stacking region to be moved, without breaking the web of said Z-fold paper, out of the way of a next stack of paper to be formed at said stacking region, and (4) said elevating means to move the temporary stacking means to its lower position, the conveyor means and the blades being relatively configured so that the blades in their extended position can pass through the stacking region, whereby, when the extended blades are moved from their upper position to their lower position with an intermediate stack of paper formed on the blades, the intermediate stack of paper is deposited onto the stacking region without breaking the continuous web of computer paper.

17. The paper handling apparatus as claimed in claim 16, wherein said control means include means for sensing when a stack of Z-fold paper forming on the stacking region of the conveyor means reaches its preestablished height and when an intermediate stack of Z-fold paper stacking on said extended blades reaches its preestablished height, the preestablished height of the intermediate stack formed on said extended blades being substantially smaller than the preestablished height of a stack of paper formed on said stacking region of the conveyor means.

18. The Z-fold computer paper handling apparatus as claimed in claim 16, wherein said intermediate stacking means comprises four stacking blades, said blades being pivotally mounted for about 90 degree rotational movement between their retracted and extended positions, said blades overlapping one another when in said retracted position and being mutually parallel when in their extended position.

19. The Z-fold computer paper handling apparatus as claimed in claim 16, including position sensing means for sensing when said stack of Z-fold paper forming at said stacking position has reached its preestablished height, when said interim stack of Z-fold paper formed on said extended blades reaches its preestablished height, and when the conveyor means has moved a stack of Z-fold paper from said stacking region toward said stack removing region a distance sufficient to permit the extended blades to deposit its intermediate stack of Z-fold paper onto said stacking region without interference between the two said stacks.

20. The Z-fold computer paper handling apparatus as claimed in claim 19, wherein said operating means are responsive to signals from said position sensing means.

21. The Z-fold computer paper handling apparatus as claimed in claim 16, including auxiliary Z-fold computer paper drive means adapted to be disposed between said printer and said upper position of said blades and including paper position sensing means disposed so as to be intermediate said auxiliary drive means and said printer, said paper position sensing means being configured for sensing when a partial loop of computer paper formed between the printer and the auxiliary drive means is larger or smaller than a preestablished loop size.

22. The Z-fold computer paper handling apparatus as claimed in claim 21, wherein said operating means are responsive for speeding the operation of said auxiliary paper drive means when the partial loop of computer paper is larger than the preestablished loop sizs and for slowing operation of said auxiliary paper drive means when the partial loop of computer paper is sensed to be smaller than the preestablished loop size.

23. The Z-fold computer paper handling apparatus as claimed in claim 16, including means for sensing when the conveyor means has moved a stack of Z-fold paper to said stack removing position,- and including means adapted for turning said printer off when a stack of Z-fold paper reaches said stacking removing position and is not removed therefrom in a preestablished time.

24. The Z-fold computer paper handling apparatus as claimed in claim 16, wherein the printer is built into a housing and wherein at least portions of said apparatus are also built into said housing.

25. The Z-fold computer paper handling apparatus as claimed in claim 16, including means for directing a puff of compressed gas toward said web of computer paper in the region of said blades as the blades are moved into their extended position from their retracted position, said puff of gas being sufficient to slightly billow the web of paper so that free ends of the blades avoid contacting transverse fold edges of the paper as the blades reach their extended position.

26. A computer printer system for printing on a continuous web of Z-fold computer paper, said printer comprising:

a. a printer cabinet;

b. a printer assembly having a printed computer paper discharge region from which a continuous web of printed Z-fold computer paper is discharged after printing;

c. conveyor means having a Z-fold paper stacking region positionable relative to said printer paper discharge region for receiving the continuous web of Z-fold computer paper discharged therefrom and for permitting said received paper to stack in a normal manner, and having a spaced apart Z-fold stack removing position from which stacks of Z-fold paper formed on the conveyor means are removed;

d. a plurality of stacking blades movable in a generally horizontal plane between an extended position so that when the blades are positioned at a first, upper position above said stacking region of the conveyor means they intercept a stream of Z-fold computer paper from said paper discharge region of the printer and enable the paper to form an intermediate stack on the blades and a retracted position wherein the blades when they are in their first, upper position, are out of the path of said stream of Z-fold paper;

e. elevating means for causing the blades to move between their first, upper position and a, second, lower position in which the extended blades are below the stacking region, the extended blades and the conveyor being relatively configured so that the extended blades can pass downwardly through the conveyor so as to deposit an intermediate stack of computer paper formed on the blades onto the stacking region without breaking the web of computer paper; and f. operating means responsive to a stack of paper forming on said stacking region reaching a preestablished height for causing, in sequence:

(1) the elevating means to have the blades at their uppermost position and in their retracted position, (2) the blades to move from their retracted position to their extended position so as to enable the intercepted stream of paper to start forming an intermediate stack of paper onto said blades, (3) the conveyor means to move the just-formed stack of Z-fold paper out of the way of a next stack of paper to be formed at said stacking region, and (4) the elevating means to move the blades to their lowermost position so that the intermediate stack of paper is deposited from the extended blades onto the stacking region of the conveyor means so that a next stack of Z-fold paper continues to stack onto said intermediate stack which forms a base thereof.

27. The Z-fold computer paper handling apparatus as claimed in claim 26, wherein said plurality of blades includes at least four blades, said four blades a being mutually parallel when they are in their extended position and being in a mutually overlapping condition when they are in their retracted position.

28. The Z-fold computer paper handling apparatus as claimed in claim 26, wherein said blades are pivotally mounted for rotation through about 90 degrees in a generally horizontal plane between their retracted and extended positions.

29. The Z-fold computer paper handling apparatus as claimed in claim 26, wherein the preestablished height of the interim stack of Z-fold paper formed on said blades is substantially less than the preestablished height for a stack of Z-fold paper at said stacking region of the conveyor means.

30. The Z-fold computer paper handling apparatus as claimed in claim 26, including position sensing means for sensing when said stack of Z-fold paper forming at said stacking position has reached its preestablished height, when said intermediate stack of Z-fold paper formed on said extended blades reaches its preestablished height, and when the conveyor means has moved a stack of Z-fold paper from said stacking region toward said stack removing region a distance sufficient to permit the extended blades to deposit its intermediate stack of Z-fold paper onto said stacking region without interference between the intermediate stack and the stack just moved from the stacking region, said operating means being responsive to signals from said position sensing means.

31. The Z-fold computer paper handling apparatus as claimed in claim 26, including means for sensing when the conveyor means has moved a stack of Z-fold paper to said stack removing position.

32. The Z-fold computer paper handling apparatus as claimed in claim 31, including means adapted for turning said printer off when a stack of Z-fold paper reaches said stacking removing position and is not removed therefrom in a preestablished time.

33. Apparatus for handling a continuous web of Z-fold computer paper as it is discharged from a printer, said apparatus comprising:

a. conveyor means having spaced apart Z-fold paper stacking and stacked paper removing regions, said stacking region being positionable relative to said printer for receiving a continuous web of Z-fold computer paper discharged therefrom and for permitting said received paper to stack thereon, said conveyor means including a conveyor and means for driving the conveyor in a direction causing a stack of Z-fold paper in said stacking region to be conveyed toward said paper stack removing region;

b. temporary stacking means, including a plurality of stacking blades and blade actuating means for causing movement of the blades in a generally horizontal plane between an extended position and a retracted position;

c. elevating means for causing the temporary stacking means to move between an uppermost position in which said blades in their extended position are positioned directly above said stacking region and are in a position to intercept a stream of Z-fold computer paper from the printer before the paper reaches the stacking region of the conveyor means to thereby enable the paper to form an intermediate paper stack on the blades and when the blades are in their retracted position they are positioned so as not to intercept said stream of Z-fold paper, and a second, lower position in which the blades are below the stacking region;

d. auxiliary Z-fold computer paper drive means adapted to be disposed between said printer and said upper position of said blades and including paper position sensing means disposed so as to be intermediate said auxiliary drive means and said printer, said paper position sensing means being configured for sensing when a partial loop of computer paper formed between the printer and the auxiliary drive means is larger or smaller than a preestablished loop size; and d. operating means connected to said conveyor drive means, said means for causing lateral movement of said blades, and said elevating means for causing, in response to a stack of Z-fold paper forming on said stacking region reaching a preestablished height, in sequence:

(1) said elevating means to locate the temporary stacking means at its uppermost position and the blade actuating means to position said blades in their retracted position, (2) said blade actuating means to move the blades from their retracted position to their extended position so as to cause the blades to intercept said stream of paper from the computer, without breaking the web of paper, so as to enable the stream of paper to start stacking on said blades, (3) said conveyor means to drive the conveyor a preestablished distance causing the stack of Z-fold paper last formed at the stacking region to be moved, without breaking the web of said Z-fold paper, out of the way of a next stack of paper to be formed at said stacking region, and (4) said elevating means to move the temporary stacking means to its lower position, the conveyor means and the blades being relatively configured so that the blades in their extended position can pass through the stacking region, whereby, when the extended blades are moved from their upper position to their lower position with an intermediate stack of paper formed on the blades, the intermediate stack of paper is deposited onto the stacking region without breaking the continuous web of computer paper, said operating means being also connected to said auxiliary paper drive means for speeding the operation thereof when the partial loop of computer paper is larger than the preestablished loop size and for slowing the operation thereof when the partial loop of computer paper is sensed to be smaller than the preestablished loop size.

* * * * *